US007147106B2

(12) United States Patent
Kowalski et al.

(10) Patent No.: US 7,147,106 B2
(45) Date of Patent: Dec. 12, 2006

(54) MATTRESS AND BEDDING PACKAGE WITH FULL PERIMETER PROTECTION AND HANDLING PIECE

(75) Inventors: Edward L. Kowalski, Summerfield, NC (US); Bruce G. Barman, Greensboro, NC (US)

(73) Assignee: Sealy Technology LLC, Trinity, NC (US)

( * ) Notice: Subject to any disclaimer, the term of this patent is extended or adjusted under 35 U.S.C. 154(b) by 187 days.

(21) Appl. No.: 10/763,535

(22) Filed: Jan. 23, 2004

(65) Prior Publication Data

US 2005/0161363 A1 Jul. 28, 2005

(51) Int. Cl.
*B65D 85/00* (2006.01)

(52) U.S. Cl. ..... 206/326; 206/497

(58) Field of Classification Search ..... 206/320, 206/326, 497, 521, 524.8, 586; 5/499; 53/434, 53/445; 150/154, 158, 165
See application file for complete search history.

(56) References Cited

U.S. PATENT DOCUMENTS 801,279 A 10/1905 Van Slyke
3,246,443 A 4/1966 Slemmons
3,611,524 A * 10/1971 Broyles ..... 29/21.1
5,226,384 A * 7/1993 Jordan ..... 119/28.5
5,472,766 A 12/1995 Siegel et al.
5,474,185 A * 12/1995 Franke ..... 206/586
5,762,260 A * 6/1998 Goglio ..... 229/199
5,934,041 A 8/1999 Rudolf et al.
6,088,859 A 7/2000 Cavazos
6,178,723 B1 1/2001 Mossbeck
6,273,257 B1 8/2001 Mossbeck
6,357,209 B1 3/2002 Mossbeck et al.
6,896,131 B1 * 5/2005 Bisbal et al. ..... 206/223
2003/0183550 A1 * 10/2003 DiLiberto, Jr. ..... 206/524.8
2004/0231054 A1 * 11/2004 Tsiarkezos ..... 5/499

* cited by examiner

*Primary Examiner*—David T. Fidei
(74) *Attorney, Agent, or Firm*—Roetzel & Andress

(57) ABSTRACT

A mattress package with a full perimeter protection and handling piece combines a barrier layer which encapsulates a mattress with a perimeter piece attached about a perimeter of the mattress proximate to the border of the mattress and preferably extending over the adjacent major surfaces of the mattress over the barrier layer. The perimeter piece provides increased strength and protection to the package about the entire perimeter of the mattress, and provides a grip for handling of the mattress which evenly distributes stresses on the package to prevent breach or failure of the package. The perimeter piece can be positioned underneath or on top of a barrier layer.

15 Claims, 5 Drawing Sheets

MATTRESS AND BEDDING PACKAGE WITH FULL PERIMETER PROTECTION AND HANDLING PIECE

FIELD OF THE INVENTION

The present invention pertains generally to packaging and protective covering, and more particularly to packages for mattresses or foundations or other products of similar characteristics, shapes or dimensions.

BACKGROUND OF THE INVENTION

The packaging of mattresses for shipping, distribution, handling and eventual sale presents a formidable challenge given the size and nature of the product. Mattresses are too large for practical packaging in a separate container such as a box, yet must have substantial protection from damage and soiling to maintain the "as new" condition required for retail marketing and sale. This has led to the widespread use of heavier gauge plastic film as a wrapping material which encapsulates the mattress. The formation of a plastic film package about a mattress has been automated, as described for example in U.S. Pat. Nos. 5,934,041; 6,178,723 and 6,273,257. These packages typically produce a fused seam of the plastic sheet material about the perimeter of the mattress which, although strong enough to keep the sealed plastic package intact, does not provide any greater barrier than the inherent strength of the plastic sheet material. The strength of this type of packaging is in many instances inadequate to protect the product completely from the factory to final installation in a purchaser's bedroom. This is largely due to the substantial size and weight of modem day mattresses, and the handling tendency to stock and move the so-packaged mattresses along the peripheral border. Because such package has no built-in gripping points, the plastic material is further stressed by gripping of a section of material by the handlers. Once the plastic is torn, either as a result of such handling or from abrasion, the mattress upholstery is readily exposed to soiling and damage, which significantly reduces the retail value or even prevents retail sale of the product. Given the substantial cost and handling requirements of these types of products, returns and recalls due to failure of the packaging are extremely costly to the manufacturer.

Thus there is a need for a mattress package which provides an improve gripping structure for handling, and which provides a greater degree of protection, particularly to the vulnerable border portions and the adjacent planar surfaces of a mattress or foundation.

SUMMARY OF THE INVENTION

In accordance with a general aspect of the invention, there is provided an improved mattress package which has a first sheet of material positioned to cover a first side of a mattress and to extend past a perimeter of the first side of the mattress; a second sheet material positioned to cover a second side of the mattress and to extend past the perimeter of the second side of the mattress; the first and second plastic sheets being joined about a perimeter of the mattress, and a perimeter piece about the perimeter of the mattress and which is joined with the first and second sheets of material.

In another aspect of the invention, there is provided a mattress package which has a barrier layer which substantially encloses a mattress, the barrier layer having first and second sheets dimensioned to cover major support surfaces of the mattress, the first and second sheets of material also extending over a border of the mattress, and being attached together; a perimeter piece attached to the barrier layer about a perimeter of the mattress and proximate to a border of the mattress, the perimeter piece in the form of a continuous band of material with a length at least equal to or greater than the perimeter of the mattress, and with a width at least equal to or greater than a width of the mattress border.

In another general aspect of the invention, there is provided a mattress package which has a barrier layer which substantially encloses a mattress, the barrier layer having first and second sheets dimensioned to cover major surfaces of the mattress, the first and second sheets of material also extending over a border of the mattress, and being attached together; a perimeter piece attached to the barrier layer about a perimeter of the mattress and proximate to a border of the mattress, the perimeter piece in the form of a continuous band of material with a length at least equal to or greater than the perimeter of the mattress, and with a width at least equal to or greater than a width of the mattress border.

And in another aspect of the invention, there is provided a mattress package which includes, in combination: a mattress having spaced apart planar sides and a border which extends between the spaced apart planar sides and which is located at a perimeter of the mattress; a barrier layer which substantially encapsulates the spaced apart planar sides and the border of the mattress; a perimeter piece positioned about the border of the mattress and substantially covering the border and extending at least partially over a portion of each of the spaced apart planar sides of the mattress.

These and other novel aspects of the invention, as applicable to mattresses, foundations, box springs, foam pads or other types of products are further described herein with reference to the accompanying Figures.

DETAILED DESCRIPTION OF PREFERRED AND ALTERNATE EMBODIMENTS

Figures 1, 2:
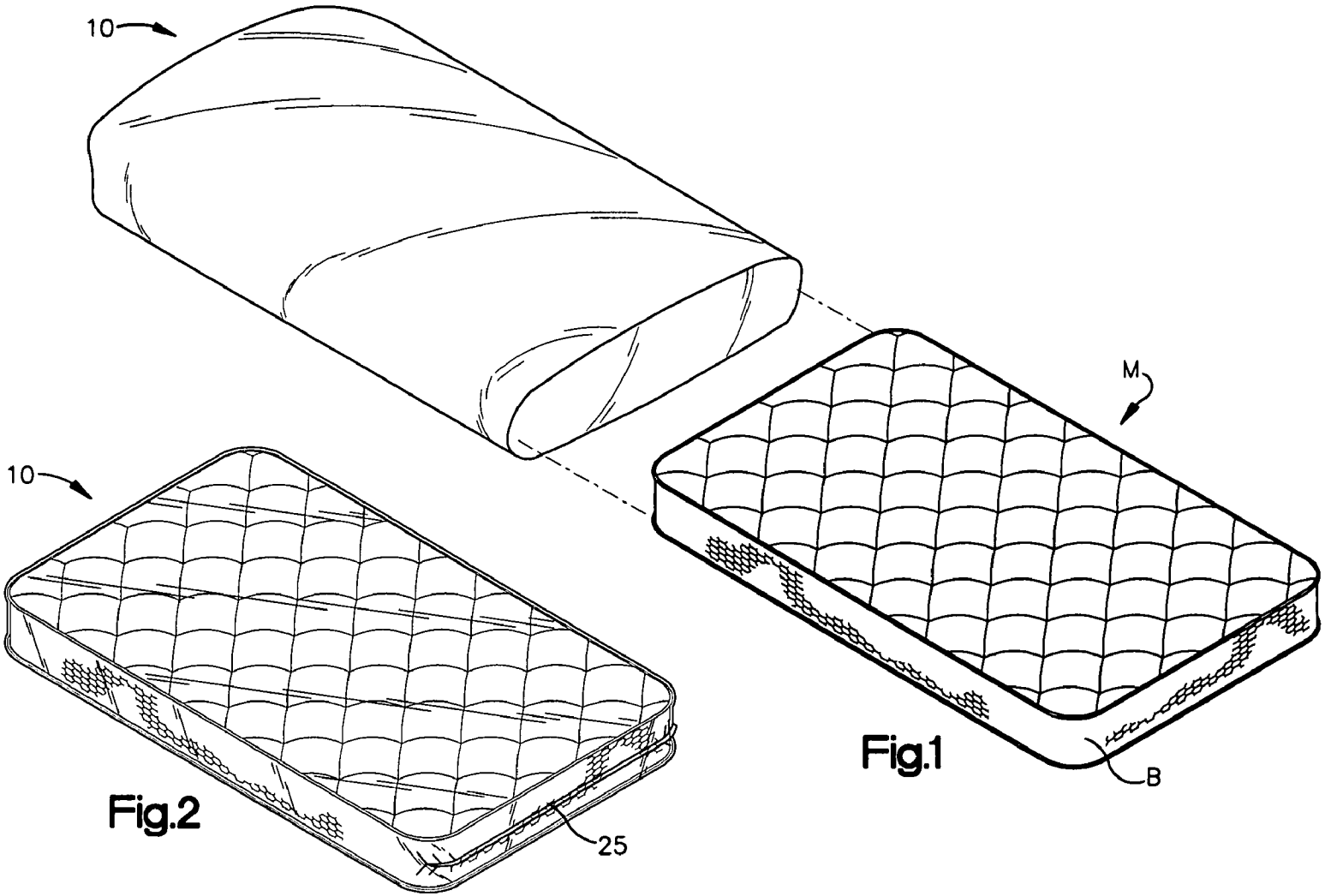
FIG. 1 illustrates a part of the mattress package of the invention in a bag form in relation to a mattress.
FIG. 2 illustrates a part of the mattress package of the invention in a bag form sealed about a mattress.
Figure 3:
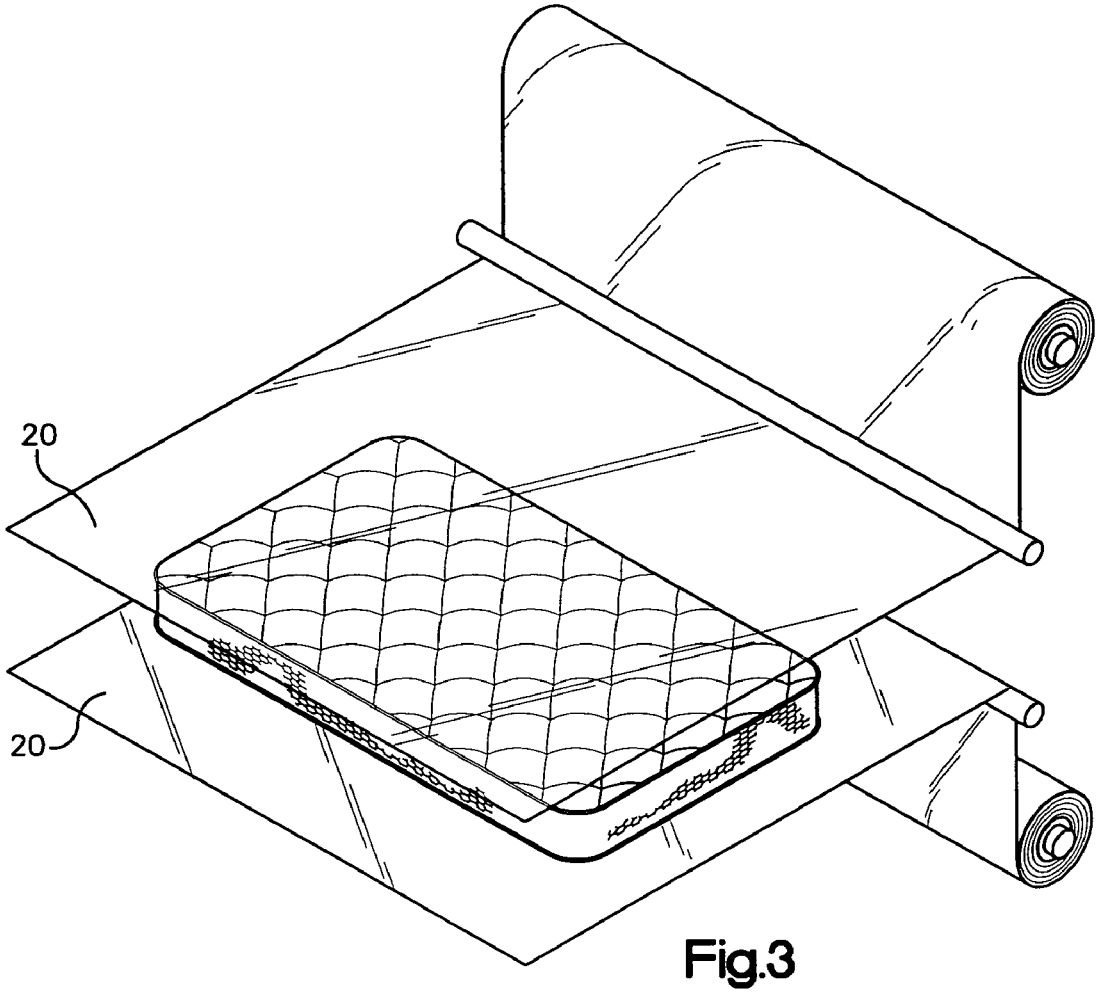
FIG. 3 illustrates a part of the mattress package of the invention in an opposing sheet form in relation to a mattress.
Figure 4:
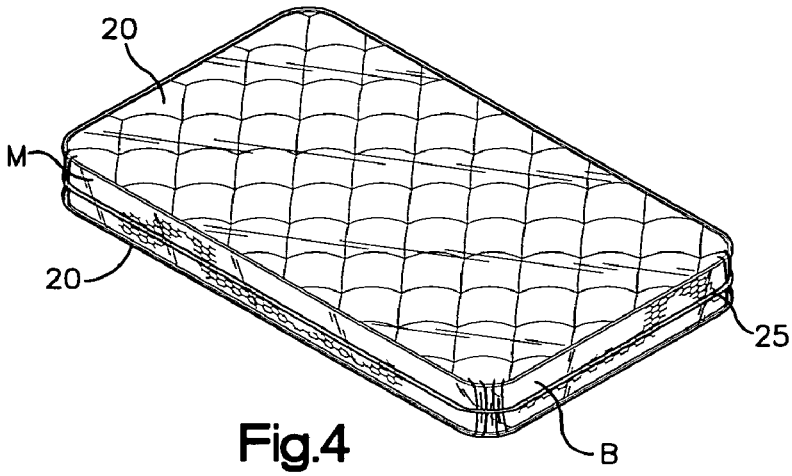
FIG. 4 illustrates a part of the mattress package of the invention in an opposing sheet form in a sealed condition about a mattress.

With reference to FIGS. 1–4, there is shown a mattress M, which may be of any of the conventional sizes made in the U.S. or in other countries of the world, which may be enclosed in a bag-like structure 10, as shown in FIGS. 1 and 2, or between two or more sheets of barrier material 20, as shown in FIGS. 3 and 4. The material of the bag 10 or sheets 20 may be any material which is suitable for packaging, which preferably provides a sufficiently durable barrier to dirt or debris coming into contact with the mattress M, and which resists mechanical damage to some degree, and which can also mold up to forces and stresses applied in the routine handling of a mattress so packaged. The bag 10 and sheets 20 are also referred to herein as a "barrier layer". Although the invention is descried with reference to the packaging and protection of a mattress M, the packaging concepts are equally applicable to other types of complimentary or comparable products such as foam or foldable mattress or cushions, foundations or box springs or similarly configured home furnishing articles.

Preferably the material of bag 10 or sheets 20 is PVC film (in a thickness range of approximately 0.5–2.0 mil) but can be any suitable material producible in sheet form and which can be sealed by thermal or mechanical means. The package of the invention is not limited to any particular manner in which the bag 10 or sheets 20 is combined with the mattress M, although as noted there are mechanical systems which automate the application and sealing of sheets of material about the mattress M. Whether done manually or by machine, FIGS. 2 and 4 illustrate the mattress package of the invention in an intermediate stage wherein the barrier layer in the form of the bag 10 or sheets 20 is sealed, for example at seal 25, or otherwise closed about the mattress M to effectively provide a first stage encapsulation of the mattress M or other article of manufacture.

Figure 8:
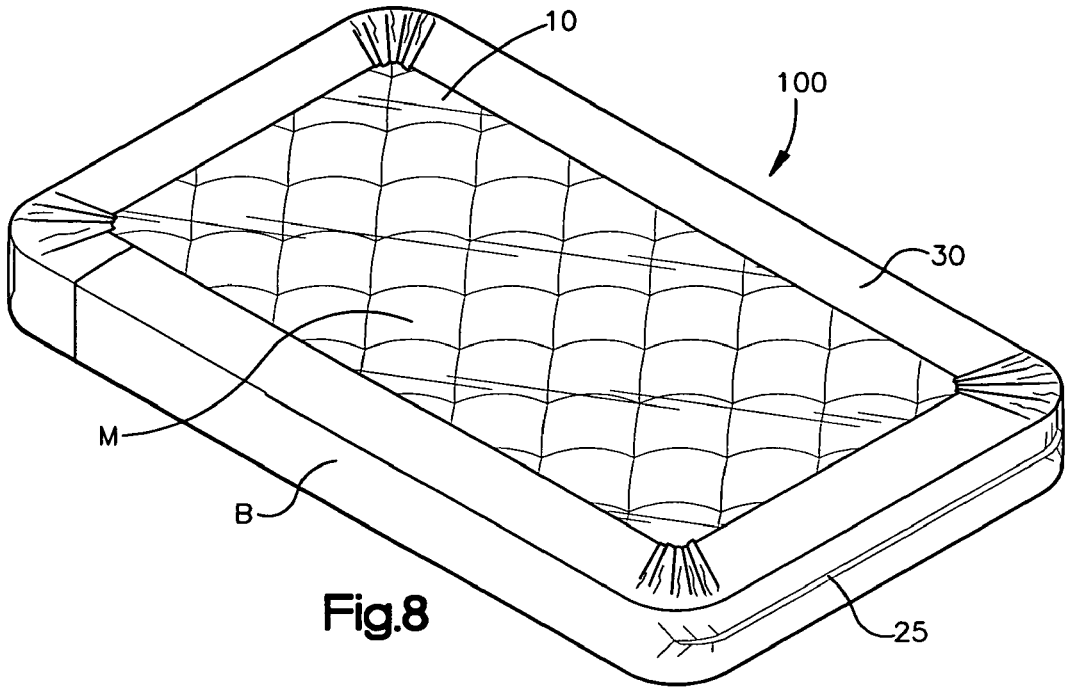
Figure 9:
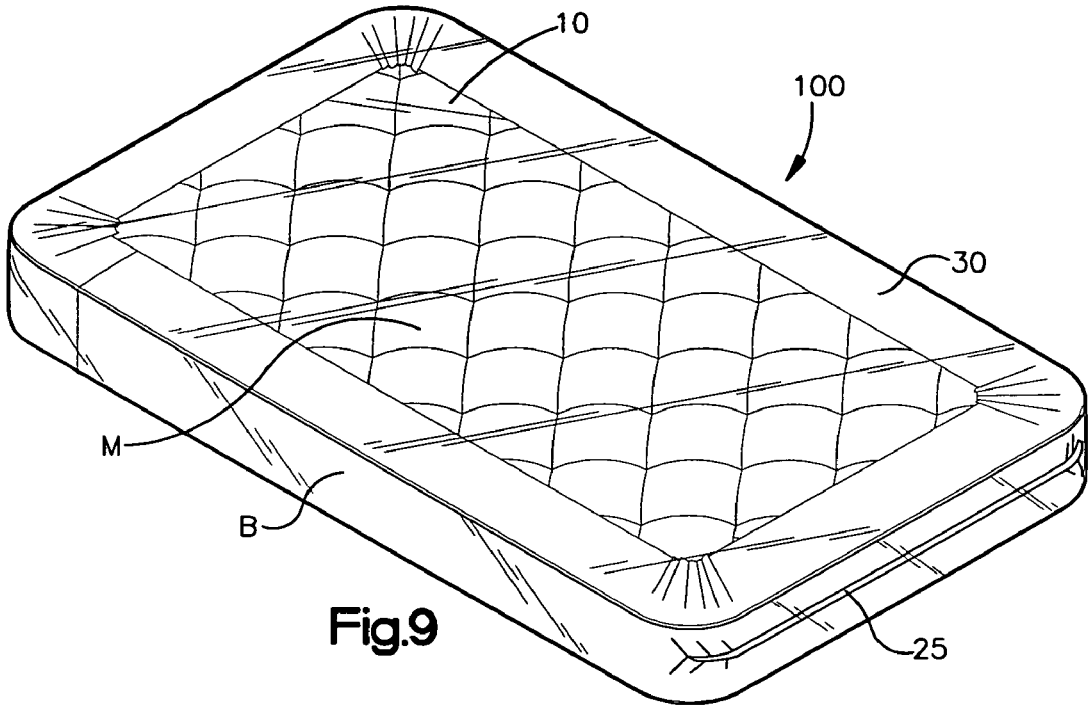
FIG. 9 illustrates an alternate mattress package of the invention in which a perimeter piece is located internal to an outer protective cover.

To complete the mattress package 100 as shown in FIG. 8, a perimeter piece 30 is combined with the barrier layer (as formed for example by either bag 10 or the combined sheets 20) by application of the perimeter piece 30 by adhesive or other bonding or fastening to the perimeter of the mattress M. The perimeter of the mattress M is defined by the mattress border B, which is generally the side wall which extends between the major planar spaced apart surfaces of the mattress. When adhesively bonded, the perimeter piece 30 conforms tightly to the barrier layer material which covers the mattress border B, so that the perimeter of the mattress package 100 which covers the border B is substantially strengthened over that of the barrier layer. Alternatively, as shown in FIG. 9, the perimeter piece 30 can be applied directly to the border B and adjacent regions of the major planar spaced apart surfaces, and the barrier layer then installed over the mattress and over the perimeter piece 30.

As further shown in FIGS. 5–8, the perimeter piece 30 in a preferred embodiment extends beyond the mattress border B to overlie a proximal portion of the adjacent major surfaces of the mattress, and is bonded or attached by adhesive or otherwise thereto. This configuration of the perimeter piece 30 relative to the barrier layer about the perimeter of the mattress provides even greater strength to the mattress package 100 at the perimeter, which is generally the highest concentration of stresses on the package 100 in the course of shipment and handling. When the perimeter piece 30 is used as a grip for handling the entire mattress M, the stresses applied to the package 100 are distributed along the length of the perimeter piece and across the expanse of the barrier layer over the major surfaces of the mattress. This gives the mattress package 100 the increased strength over packaging of the prior art, which prevents breach or failure of the package and consequent damage to the mattress M.

The perimeter piece 30 also provides a distinctive product package 100, by for example being made of a material of different or complimentary color to the product or accompanying barrier layer, and as a background for company or dealer names and trademarks printed directly on the perimeter piece material or applied separately.

Figure 5:
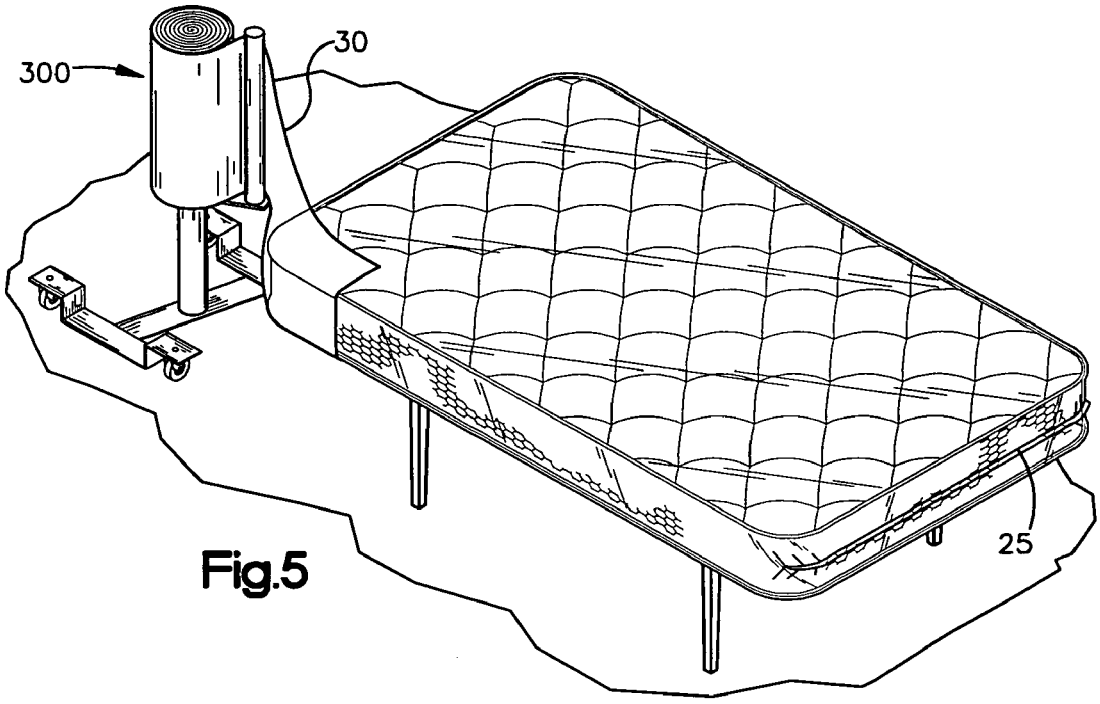
FIGS. 5 and 6 illustrate an arrangement for application of the perimeter seal portion of the mattress package of the invention about the perimeter of a mattress enclosed in a bag type barrier.
Figure 6:
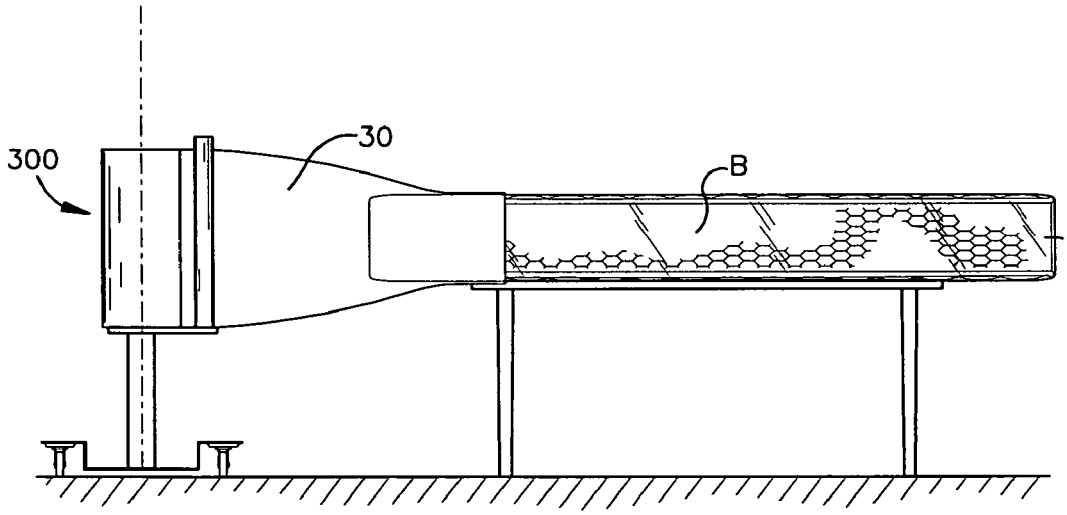
Figure 7:
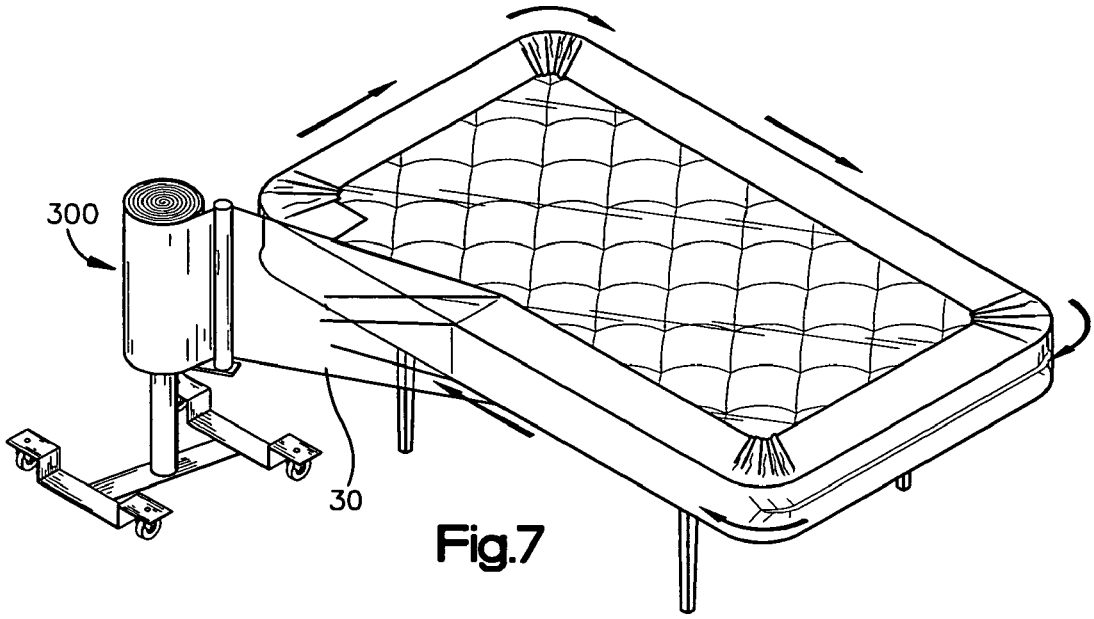
FIGS. 7 and 8 illustrate an arrangement for application of the perimeter seal portion of the mattress package of the invention about a perimeter of a mattress enclosed in a sealed opposed sheet type barrier.

As shown in FIGS. 5–7, a system for applying the perimeter piece 30 to the barrier layer on the mattress M about the border B of the mattress, to form the mattress package 100, utilizes a spool of perimeter piece material stock 300, for example in the form of a spool or reel, positioned adjacent to the mattress M and dispensed for direct application over the barrier layer about the border B and on to the adjacent major surfaces of the mattress. Either the perimeter piece material stock 300 or mattress M can be placed on a mobile stand to facilitate relative movement for the full perimeter application. The fixed height of the perimeter piece material stock 300 relative to the mattress insures uniform distribution of the perimeter piece 30 relative to the opposing major surfaces of the mattress M.

The resulting packaged mattress shown in FIG. 8 provides a fully integrated and extremely strong package which effectively withstands abrasion and handling stress to maintain the integrity of the package and fully protect the mattress. The double thickness of the package 100 about the entire perimeter is also advantageous for environmental and fire protection.

FIG. 9 illustrates an alternate embodiment of the package of the invention, wherein the perimeter piece 30 is located inside of an outer protective layer formed by bag 10 or sheets 20. In this embodiment, the perimeter piece 30 is placed in direct contact with the packaged product, e.g., mattress, foundation, cushion or the like, prior to encapsulation of the product in the protective cover. For this embodiment, the perimeter piece 30 can be made of a polymer/plastic sheet film, such as thin-film PVC, which has inherent clinging properties, so that the perimeter piece can be tightly fit about the perimeter and adhered to itself. Alternatively, a light tack adhesive can be applied to interior surface of the perimeter piece 30 for direct adhesion to the packaged product. Adhesive can also be used on the exterior surface of the perimeter piece for adhesion to the outer protective layer such as sheets 20.

What is claimed as the invention is:

1. A mattress package comprising:

a barrier layer which substantially encloses a mattress, the barrier layer having first and second sheets dimensioned to cover major surfaces of the mattress, the first and second sheets of material also extending over a border of the mattress, and being attached together;

a perimeter piece attached to the barrier layer about a perimeter of the mattress and proximate to a border of the mattress, the perimeter piece in the form of a continuous band of material with a length at least equal to or greater than the perimeter of the mattress, and with a width at least equal to or greater than a width of the mattress border.

2. The mattress package of claim 1 wherein the sheets of the barrier layer are sealed together by a seal and the perimeter piece extends over the seal.

3. The mattress package of claim 1 wherein the sheets of the barrier layer are joined to form a bag in which the mattress is positioned.

4. The mattress package of claim 1 wherein a thickness of the perimeter piece is greater than a thickness of the barrier layer.

5. The mattress package of claim 1 wherein the perimeter piece is adhesively bonded to the barrier layer.

6. The mattress package of claim 1 wherein the perimeter piece extends over the barrier layer over the border of the mattress and over a portion of the first and second sheets of the barrier layer.

7. The mattress package of claim 1 wherein the perimeter piece extends over a thermally formed seal of the first and second sheets of the barrier layer.

8. The mattress package of claim 1 wherein the perimeter piece fits substantially tightly against the border of the mattress over the barrier layer.

9. The mattress package of claim 1 wherein the perimeter piece has indicia on an outside surface of the perimeter piece.

10. A mattress package comprising, in combination:

a mattress having spaced apart planar sides and a border which extends between the spaced apart planar sides and which is located at a perimeter of the mattress;

a barrier layer which substantially encapsulates the spaced apart planar sides and the border of the mattress;

a perimeter piece positioned about the border of the mattress and substantially covering the border and extending at least partially over a portion of each of the spaced apart planar sides of the mattress.

11. The mattress package of claim 10 wherein the barrier layer is placed directly against exterior surfaces of the mattress.

12. The mattress package of claim 10 wherein the perimeter piece is located internal to the barrier layer.

13. The mattress package of claim 10 further comprising an adhesive in combination with the perimeter piece.

14. The mattress package of claim 13 wherein the perimeter piece is adhesively secured to at least a portion of the mattress.

15. The mattress package of claim 13 wherein the perimeter piece is adhesively secured to at least a portion of the barrier layer.

* * * * *